US010283855B2

(12) United States Patent
Yosui et al.

(10) Patent No.: US 10,283,855 B2
(45) Date of Patent: May 7, 2019

(54) ANTENNA ELEMENT AND METHOD OF MANUFACTURING THE SAME

(71) Applicant: Murata Manufacturing Co., Ltd., Nagaokakyo-shi, Kyoto-fu (JP)

(72) Inventors: Kuniaki Yosui, Nagaokakyo (JP); Isamu Morita, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 188 days.

(21) Appl. No.: 15/618,221

(22) Filed: Jun. 9, 2017

(65) Prior Publication Data

US 2017/0279191 A1 Sep. 28, 2017

Related U.S. Application Data

(63) Continuation of application No. PCT/JP2016/062585, filed on Apr. 21, 2016.

(30) Foreign Application Priority Data

May 8, 2015 (JP) ..... 2015-095646

(51) Int. Cl.

| | |
|---|---|
| ***H01Q 1/38*** | (2006.01) |
| ***H01Q 9/04*** | (2006.01) |
| ***H01Q 1/22*** | (2006.01) |
| ***H01Q 9/42*** | (2006.01) |

(52) U.S. Cl.

CPC ..... *H01Q 1/38* (2013.01); *H01Q 1/2283* (2013.01); *H01Q 9/0421* (2013.01); *H01Q 9/42* (2013.01)

(58) Field of Classification Search

CPC ..... H01Q 1/38; H01Q 9/0421

See application file for complete search history.

(56) References Cited

U.S. PATENT DOCUMENTS

| | | | | |
|---|---|---|---|---|
| 2006/0176220 | A1 | 8/2006 | Tamaoka | |
| 2015/0214627 | A1* | 7/2015 | Komoriya | H01Q 9/0471 343/895 |
| 2015/0244066 | A1 | 8/2015 | Takano et al. | |

FOREIGN PATENT DOCUMENTS

| | | | |
|---|---|---|---|
| JP | 2005-151105 | A | 6/2005 |
| JP | 2005-303637 | A | 10/2005 |
| JP | 2009-159588 | A | 7/2009 |
| JP | 2011-211445 | A | 10/2011 |
| JP | 2015-181222 | A | 10/2015 |
| WO | 2014/042070 | A1 | 3/2014 |

OTHER PUBLICATIONS

Official Communication issued in International Patent Application No. PCT/JP2016/062585, dated Jul. 12, 2016.

* cited by examiner

*Primary Examiner* — Dameon E Levi
*Assistant Examiner* — David E Lotter
(74) *Attorney, Agent, or Firm* — Keating & Bennett, LLP

(57) ABSTRACT

An antenna defined by a conductive pattern is in contact with a laminate including insulator layers, one of which has a conductive pattern thereon. A first insulator layer has a surface that is a first principal surface of the laminate. The laminate includes a thick wall portion and a thin wall portion, and an antenna defined by the conductive pattern is located on the surface of the first insulator layer and a portion of the antenna traverses a boundary between the thick wall portion and the thin wall portion.

19 Claims, 16 Drawing Sheets

ANTENNA ELEMENT AND METHOD OF MANUFACTURING THE SAME

CROSS REFERENCE TO RELATED APPLICATIONS

This application claims the benefit of priority to Japanese Patent Application No. 2015-095646 filed on May 8, 2015 and is a Continuation Application of PCT Application No. PCT/JP2016/062585 filed on Apr. 21, 2016. The entire contents of each application are hereby incorporated herein by reference.

BACKGROUND OF THE INVENTION

1. Field of the Invention

The present invention relates to an antenna element, and in particular, to an antenna element in which an antenna defined by a conductive pattern is provided in a laminate and a method of manufacturing the antenna element.

2. Description of the Related Art

Antenna elements included in small electronic devices such as communication terminal devices commonly have a structure in which an antenna defined by a conductive pattern is provided on an insulating base.

In recent years, due to increasingly thinner and smaller electronic devices having such an antenna element incorporated therein, it is usually necessary to dispose the antenna element at a position away from a circuit board within the limited space of the housing of the electronic device. It is thus preferable to mold the antenna element not in a simple rectangular parallelepiped shape but in a shape suitable of being accommodated in the housing.

As described in, for example, WO 2014/042070, a method has been employed in which an antenna defined by a plated film pattern is directly formed on the surface of a resin mold using the Laser Direct Structuring (LDS) process.

The LDS process mentioned above irradiates laser light onto the surface of a resin mold containing an LDS additive and activates only the portion of the surface irradiated by the laser light to selectively form a plated film on the activated part. The LDS process enables a conductive pattern to be formed particularly on the surface of the resin mold with recesses and protrusions, and thus has an advantage of being capable of molding an antenna element that is usually disposed at the end of a housing in a shape conforming to the shape of the housing.

However, it is necessary to perform a step of applying a catalyst activated by laser light on a resin mold and thus a manufacturing process is complicated. Additionally, a resin used as an insulator is easily modified and thus antenna characteristics may be degraded.

SUMMARY OF THE INVENTION

Preferred embodiments of the present invention provide an antenna element that eliminates resin modification and is easily manufactured, and a method of manufacturing the antenna element.

According to a preferred embodiment of the present invention, an antenna element includes an antenna defined by a conductive pattern in contact with a laminate including a plurality of insulator layers, in which a surface of a first insulator layer of the plurality of insulator layers defines a first principal surface of the laminate, the laminate includes a thick wall portion and a thin wall portion depending on a number of insulator layers being laminated, and the antenna is provided on the surface of the first insulator layer and a portion of the antenna traverses a boundary between the thick wall portion and the thin wall portion.

With such a structure, it is possible to provide an antenna element that uses a laminate including insulator layers as an insulating base with recesses and protrusions or steps on its surface and that includes an antenna defined by a conductive pattern on the recesses and protrusions or the steps.

The conductive pattern provided on at least one of the plurality of insulator layers preferably is, for example, a ground conductive pattern. This enables the positional relationship between the antenna and the ground conductor to be constant, achieving stable characteristics of the antenna.

The conductive pattern provided on at least one of the plurality of insulator layers preferably is, for example, a conductive pattern that defines an inductor or a capacitor. A matching circuit is thus able to be integrally formed with the antenna.

Each of the insulator layers is preferably made of a deformable material and a connector is preferably disposed on the thin wall portion of the laminate. The height of the connector projecting from the laminate is thus reduced, achieving a thin antenna element.

The connector is preferably mounted on the first principal surface of the laminate and electrically connected to the conductive pattern provided on the first principal surface. Consequently, it is not necessary to provide a via conductor for connecting the connector, and conductor loss is reduced.

A component is preferably disposed on the thin wall portion of the laminate. It is thus possible to provide a thin antenna element including a circuit such as a matching circuit.

Preferably, the thin wall portion of the laminate defines a trench on the first principal surface of the laminate, the component includes an external electrode on a bottom surface and a side surface, the component is disposed in the trench of the laminate, and the external electrode of the component is bonded to the conductive pattern provided in the trench. This effectively increases the bond strength of the component. Additionally, it is possible to prevent the increase in the thickness of the antenna element due to mounting of the component.

According to a preferred embodiment of the present invention, a method of manufacturing an antenna element including an antenna defined by a conductive pattern in contact with a laminate formed by laminating a plurality of insulator layers, includes a first step of preparing a plurality of insulating bases corresponding to the plurality of insulator layers, a second step of forming the conductive pattern on a predetermined insulating base of the plurality of insulating bases, a third step of laminating the plurality of insulating bases such that a first insulator layer with a surface that defines a first principal surface of the laminate is formed, an area that becomes a thick wall portion or a thin wall portion depending on a number of insulator layers being laminated is provided, and a portion of the conductive pattern traverses a boundary between the thick wall portion and the thin wall portion, and a fourth step of pressurizing the laminate.

With such a method and resulting structure, it is possible to provide an antenna element that uses a laminate formed by laminating insulator layers as an insulating base with recesses and protrusions or steps on its surface and that includes an antenna defined by a conductive pattern on the recesses and protrusions or the steps.

Each of the insulating bases is preferably made of a thermoplastic resin and the fourth step is preferably a step of integrally molding the laminate by hot pressing. Resin flowability thus allows the antenna element with predetermined recesses and protrusions or steps on the surface to be easily formed.

A step of forming a cut-away portion in the first insulating base is further included. The insulating bases are preferably laminated at the third step in a manner that the cut-away portion is placed on the boundary between the thick wall portion and the thin wall portion. The first insulator layer thus bends easily at the cut-away portion, achieving a rapid change in thickness at the boundary between the thick wall portion and the thin wall portion.

According to various preferred embodiments of the present invention, it is possible to provide an antenna element that uses a laminate formed by laminating insulator layers as an insulating base with recesses and protrusions or steps on its surface and that includes an antenna defined by a conductive pattern on the recesses and protrusions or the steps.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
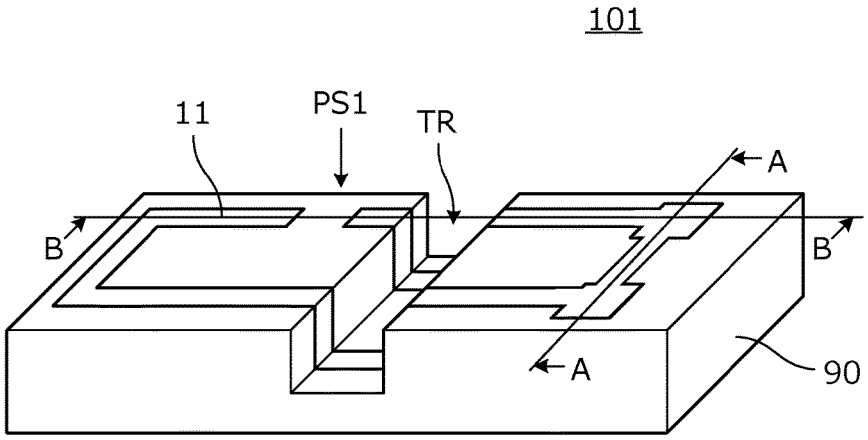
FIG. 1 is a perspective view of an antenna element 101 according to a first preferred embodiment of the present invention.

A plurality of preferred embodiments of the present invention are described below using several specific examples with reference to the drawings. In the drawings, the same reference signs denote the same elements and features. To describe the subject matter of the present invention or easily understand the present invention, the preferred embodiments are described separately for convenience, and partial replacements or combinations of structures described in different preferred embodiments can be made. The descriptions of matters common to those of the first preferred embodiment are omitted in the second and subsequent preferred embodiments and only different portions are described. In particular, similar operations and effects obtained by similar structures are not described in each preferred embodiment.

First Preferred Embodiment

A first preferred embodiment describes an example of an antenna element that is provided in a small electronic device such as a communication terminal device.

FIG. 1 is a perspective view of an antenna element 101 according to the first preferred embodiment. The antenna element 101 includes a laminate 90 including laminating insulator layers and an antenna defined by a conductive pattern 11 on the laminate 90.

A trench TR is provided on a first principal surface PS1 of the laminate 90 (an upper surface of the laminate 90 from the view of FIG. 1). The conductive pattern 11 traverses the boundary between a portion not including the trench TR (thick wall portion) and the trench TR (thin wall portion).

Figure 2A:
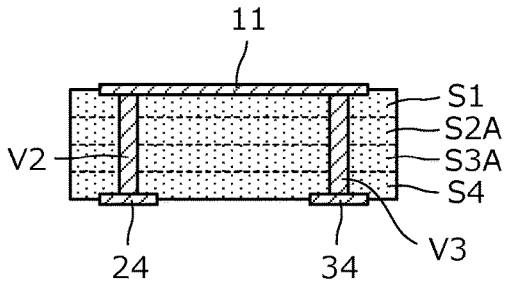
FIG. 2A is a cross-sectional view taken along a line A-A in FIG. 1.
Figure 2B:
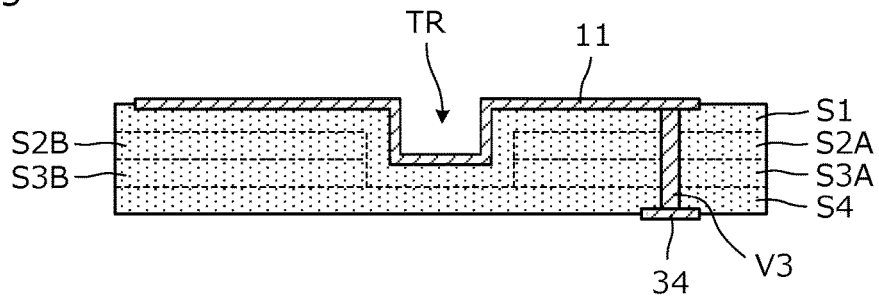
FIG. 2B is a cross-sectional view taken along a line B-B in FIG. 1.
Figure 3:
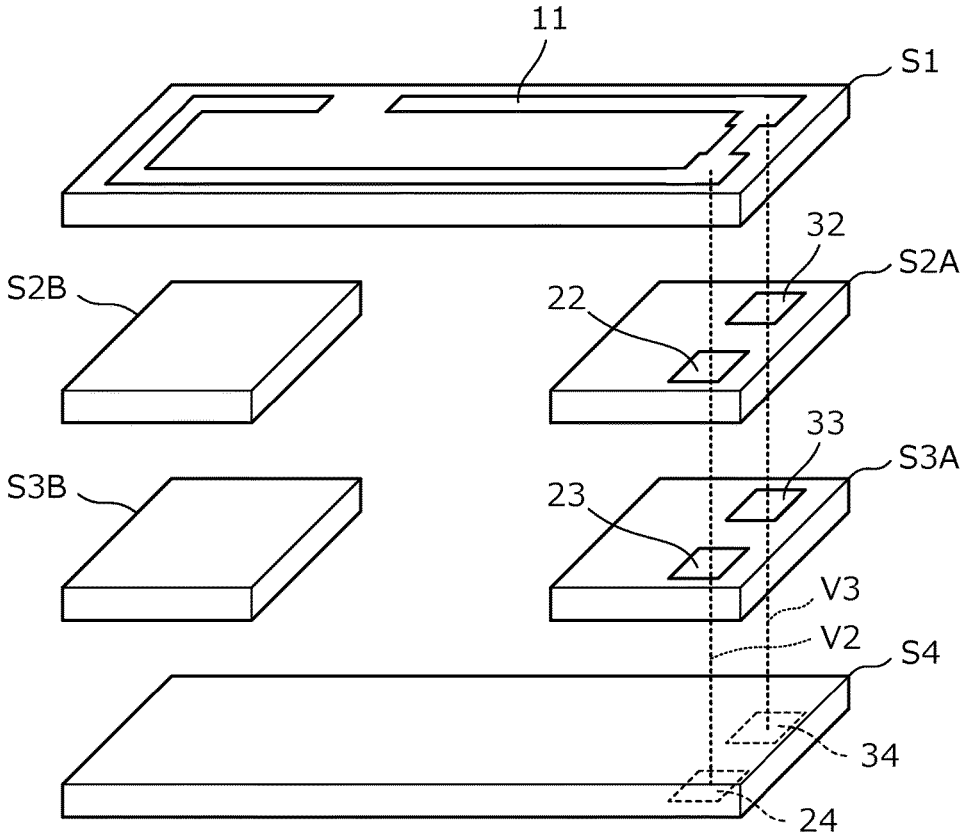
FIG. 3 is an exploded perspective view of the antenna element 101.

FIG. 2A is a cross-sectional view taken along a line A-A in FIG. 1, and FIG. 2B is a cross-sectional view taken along a line B-B in FIG. 1. FIG. 3 is an exploded perspective view of the antenna element 101.

The laminate 90 is formed preferably by laminating insulator layers S1, S2A, S2B, S3A, S3B, and S4. The insulator layers S2A, S2B, S3A, and S3B are smaller than the insulator layers S1 and S4. The laminate 90 includes an area where the insulator layers S1, S2A, S3A, and S4 are laminated, an area where the insulator layers S1, S2B, S3B, and S4 are laminated, and an area where the insulator layers S1 and S4 are laminated. A surface of the first insulator layer S1 defines the first principal surface PS1 of the laminate 90, and the first insulator layer S1 contacts the insulator layers S2A, S2B, S3A, S3B, and S4. In other words, the laminate 90 includes several thick wall portions and thin wall portions depending on the number of laminated insulator layers, and the thin wall portion defines the trench TR.

The conductive pattern 11 is provided on the surface of the first insulator layer S1. Conductive patterns 22 and 32 are provided on an upper surface of the insulator layer S2A and conductive patterns 23 and 33 are provided on an upper surface of the insulator layer S3A. Conductive patterns 24 and 34 are provided on a lower surface of the insulator layer S4. The conductive patterns 24 and 34 are used as terminal electrodes. The conductive patterns 24 and 34 are connected through via conductors V2 and V3 to predetermined positions on the conductive pattern 11, respectively.

The insulator layers S1, S2A, S2B, S3A, S3B, and S4 are, for example, sheets of a deformable material of a thermoplastic resin such as a liquid crystal polymer (LCP). The conductive pattern 11 is, for example, a patterned Cu foil.

The antenna element 101 according to the present preferred embodiment is manufactured by, for example, the following steps.

First Step

A plurality of insulating bases corresponding to the plurality of insulator layers S1, S2A, S2B, S3A, S3B, and S4 are prepared. Each of the insulating bases is a sheet of a deformable material such as a liquid crystal polymer (LCP) and a metal foil such as a Cu foil is attached on the surface.

Second Step

Metal foils on predetermined insulating bases (insulating bases that become the insulator layers S1, S2A, S3A, and S4) of the plurality of insulating bases are patterned to form the conductive patterns 11, 22, 32, 23, 33, 24, and 34. A conductive paste is filled in holes formed in the insulating bases in advance to form the via conductors V2 and V3.

Third Step

The plurality of insulating bases are laminated such that an area that becomes a thick wall portion or an area that becomes a thin wall portion is provided depending on the number of laminated insulator layers, the first insulator layer S1 with a surface that is the first principal surface PS1 of the laminate 90 is formed, and a portion of the conductive pattern 11 traverses the boundary between the thick wall portion and the thin wall portion in a planar view of the insulating base. In this way, a laminate which is a motherboard is formed.

Fourth Step

Figure 4:
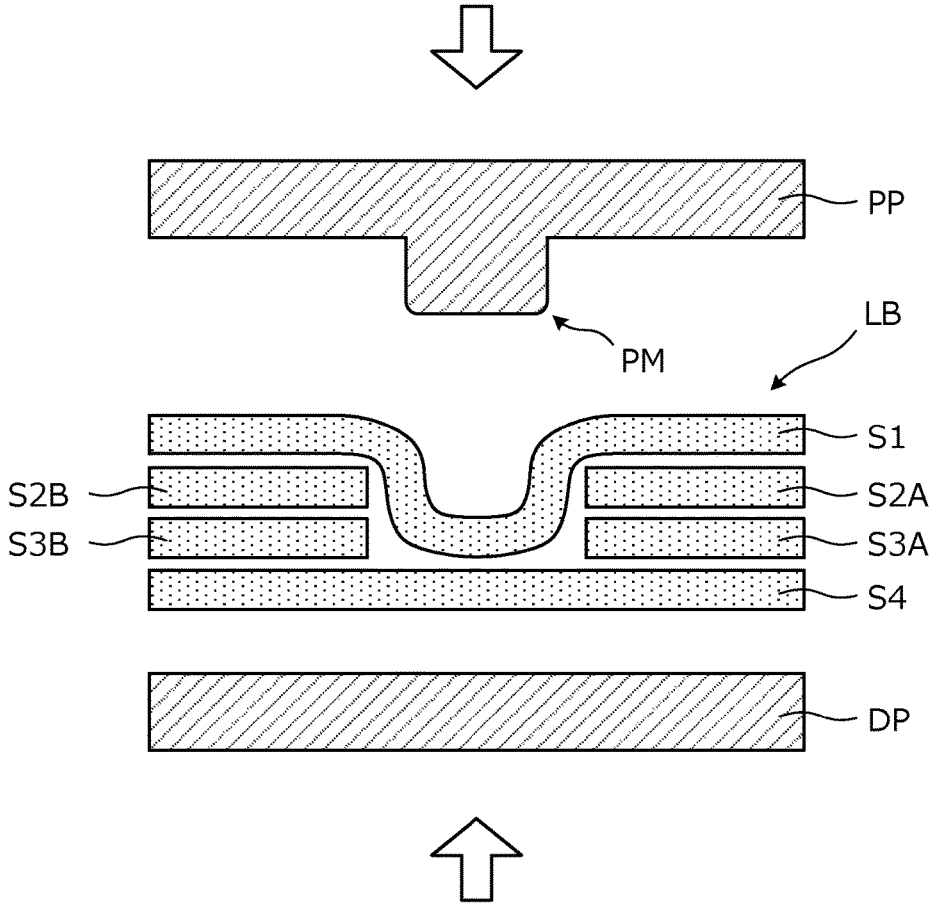
FIG. 4 shows a process of a fourth step.

The above-mentioned laminate is integrated by hot pressing. FIG. 4 shows this process at the fourth step. The above-mentioned laminate LB is placed on a die plate DP and sandwiched between the die plate DP and a punch plate PP. A projection PM is formed on the punch plate PP. The projection PM of the punch plate PP presses the thin wall portion and the other areas of the punch plate PP press the thick wall portion. The trench TR is thus formed in the first principal surface PS1 while a surface of the laminate 90 opposite to the first principal surface PS1 remains flat. A cushion liner may be sandwiched between the punch plate and the laminate LB. Pressing force on the laminate LB is thus able to be equalized. Hot pressing may be performed using, in addition to uniaxial pressing shown in FIG. 4, isotropic pressing in which a surface opposite to a surface with recesses and protrusions is rigid.

The conductive pattern 11 may be an arbitrary pattern regardless of the shape of the trench TR, since the conductive pattern 11 is formed on the insulating base that becomes the first insulator layer S1.

Fifth Step

The laminate 90 is cut out of the laminate which is a motherboard.

The antenna element 101 shown in FIG. 1 is obtained by the steps described above.

As described above, it is possible to provide an antenna element that uses a laminate formed by laminating insulator layers as an insulating base with recesses and protrusions or steps on its surface and that includes an antenna defined by a conductive pattern on the recesses and protrusions or the steps. According to the present preferred embodiment, the insulator layers are preferably formed of insulating bases made of the identical thermoplastic resin, and are thus able to be integrated without any adhesive by a simple process such as hot pressing.

Figure 5:
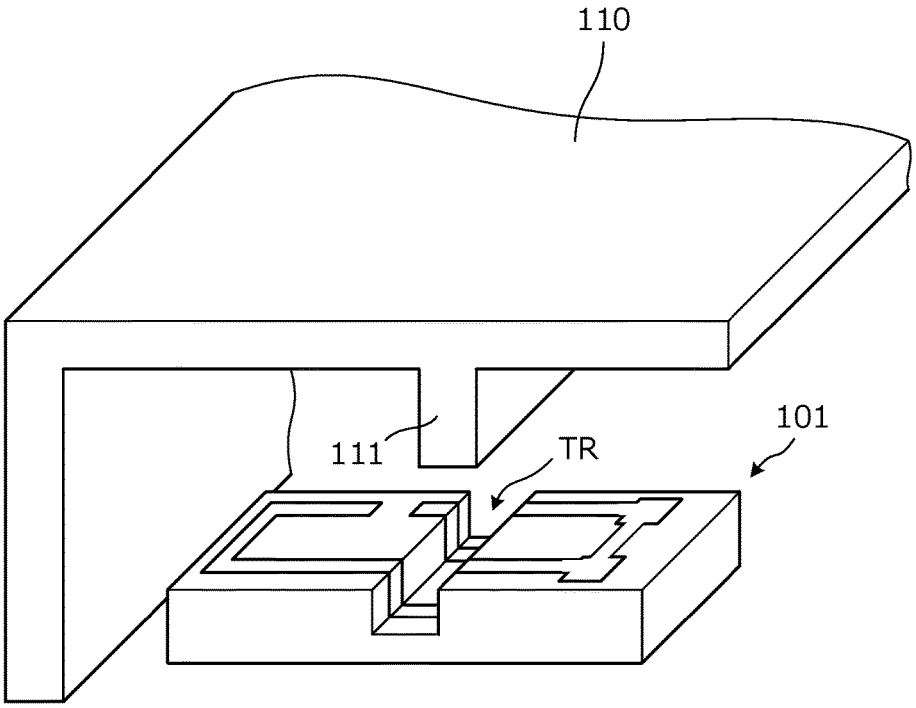
FIG. 5 is a partial perspective view of a portion in which the antenna element 101 is disposed in a housing of an electronic device.

FIG. 5 is a partial perspective view of a portion in which the antenna element 101 is disposed in a housing of an electronic device. A projection 111 that projects inward is provided on a housing 110 of the electronic device. The antenna element 101 is disposed in the housing 110 so that the projection 111 extends into the trench TR. When the antenna element 101 is disposed in the housing of the electronic device, the position of the antenna element 101 is able to be fixed by the trench TR and disposed in the limited space of the housing.

Figure 6:
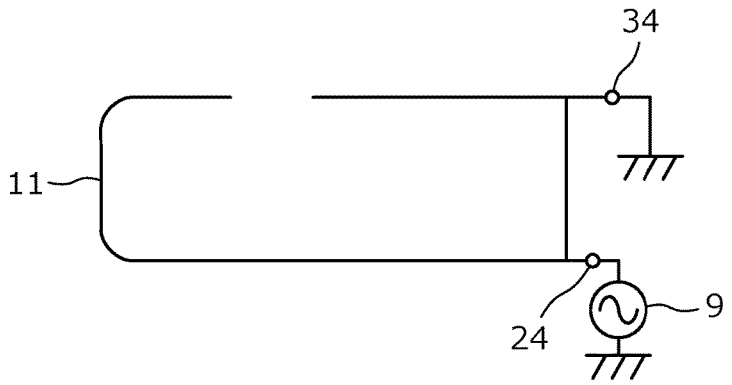
FIG. 6 is a circuit diagram in which the antenna element 101 is connected to a power supply circuit.

FIG. 6 is a circuit diagram in which the antenna element 101 according to the present preferred embodiment is connected to a power supply circuit. As the conductive pattern 11 defines and functions as a radiation element, the conductive pattern 34 defining and functioning as a terminal electrode is grounded, and the conductive pattern 24 defining and functioning as a terminal electrode is connected to a power supply circuit 9, an inverted-F antenna is provided. If an electrically inward position from an end of the conductive pattern 11 by a predetermined distance is determined as a power supply point, the antenna defines and functions as a dual-band antenna.

According to the present preferred embodiment, the manufacturing cost is less than that of the LDS process and the insulator layer is less likely to be modified than that of the LDS process, so that high frequency characteristics are not degraded. The antenna element is suitable for a high frequency component because it is not necessary to form a conductive pattern extending in a lamination direction of the insulator layer using an inter-layer connection conductor such as a via conductor, and small conductor loss is maintained.

Second Preferred Embodiment

A second preferred embodiment of the present invention describes an example of an antenna element that is partially different from the antenna element according to the first preferred embodiment in the structure of an insulator layer.

Figure 7:
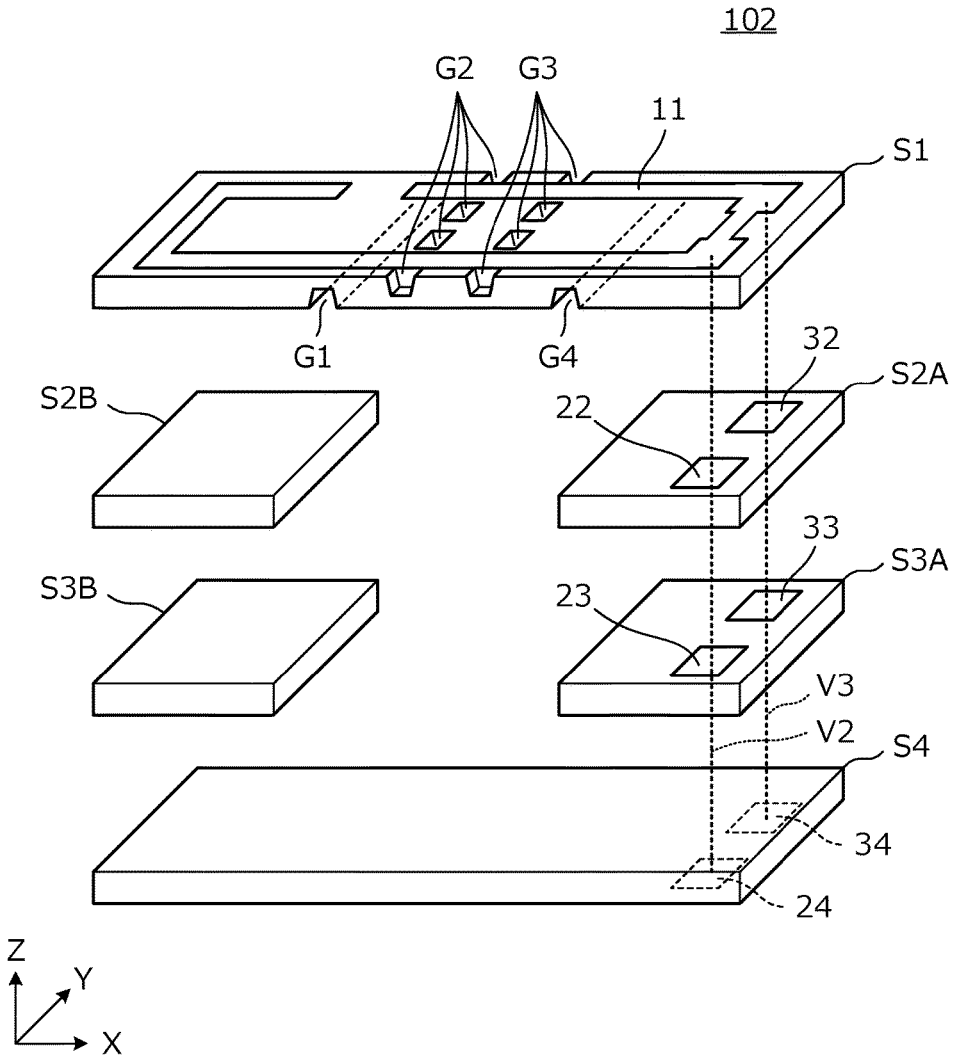
FIG. 7 is an exploded perspective view of an antenna element 102 according to a second preferred embodiment of the present invention.

FIG. 7 is an exploded perspective view of an antenna element 102 according to the second preferred embodiment. The antenna element 102 includes insulator layers S1, S2A, S2B, S3A, S3B, and S4. The structure of the insulator layer S1 is different from that of the first preferred embodiment shown in FIG. 3. Trench-shaped cut-away portions G1, G2, G3, and G4 are provided in the insulator layer S1 shown in FIG. 7. The other structures are identical to those of the first preferred embodiment.

The cut-away portions G1 and G4 are provided in a lower surface of the insulator layer S1 and the cut-away portions G2 and G3 are provided in an upper surface of the insulator layer S1. The cut-away portions G1 and G4 are provided at positions that become edges of trenches of a laminate and the cut-away portions G2 and G3 are provided at positions that become corners of the trenches of the laminate. The cut-away portions G1 and G4 extend continuously in a Y-axis direction and the cut-away portion G2 and G3 extend in the Y-axis direction like a dashed-line so as not to break a conductive pattern 11. These cut-away portions G1, G2, G3, and G4 are formed by, for example, laser processing.

Figure 8:
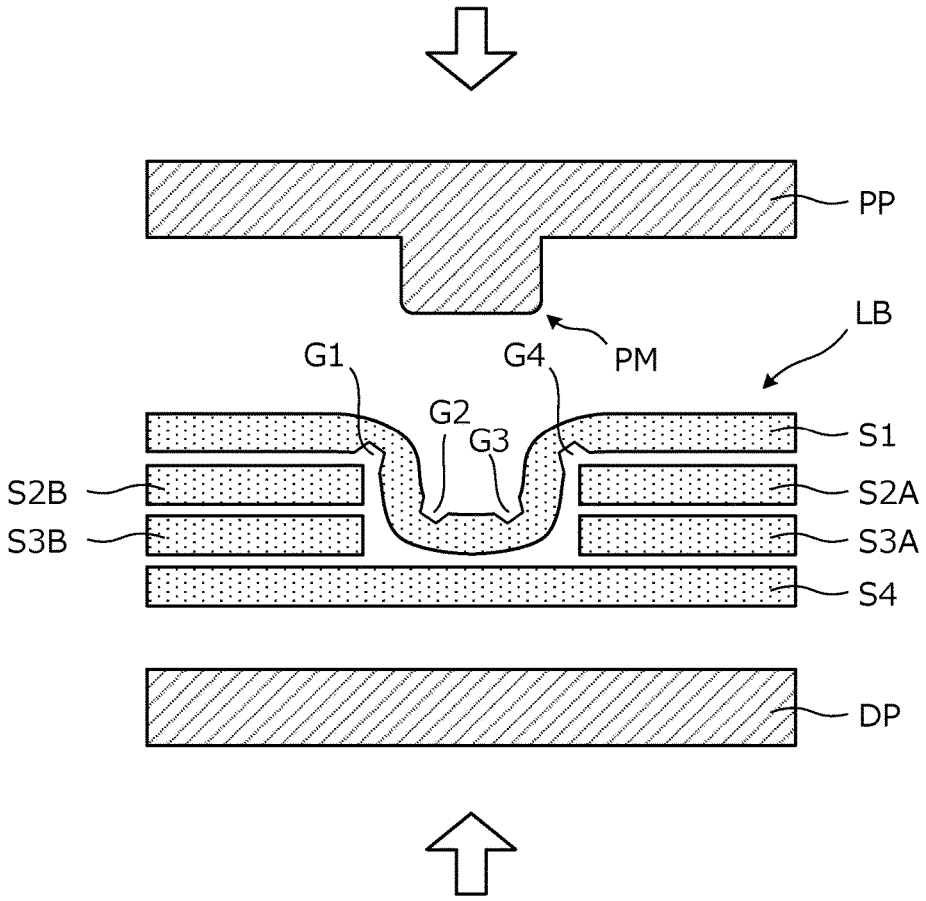
FIG. 8 shows a process of a hot pressing step.

FIG. 8 shows a process at a hot pressing step. A laminate LB is placed on a die plate DP and sandwiched between the die plate DP and a punch plate PP. A projection PM is provided on the punch plate PP. The projection PM of the punch plate PP presses a thin wall portion, and the other areas of the punch plate PP press a thick wall portion. The first insulator layer S1 bends easily at the cut-away portions G1, G2, G3, and G4 to contact more tightly the other insulator layers S2A, S2B, S3A, S3B, and S4, achieving a rapid change in thickness at the boundary between the thick wall portion and the thin wall portion.

While the cut-away portions G1, G2, G3, and G4 are placed inside of the bending portions of the insulator layer S1 in the example shown in FIGS. 7 and 8, the cut-away portions may be placed outside of the bending portions of the insulator layer S1. Alternatively, the cut-away portions may be placed both inside and outside of the bending portions of the insulator layer S1.

Third Preferred Embodiment

A third preferred embodiment of the present invention describes an example of an antenna element that includes a conductive pattern in addition to a conductive pattern defining and functioning as a radiation element.

Figure 9:
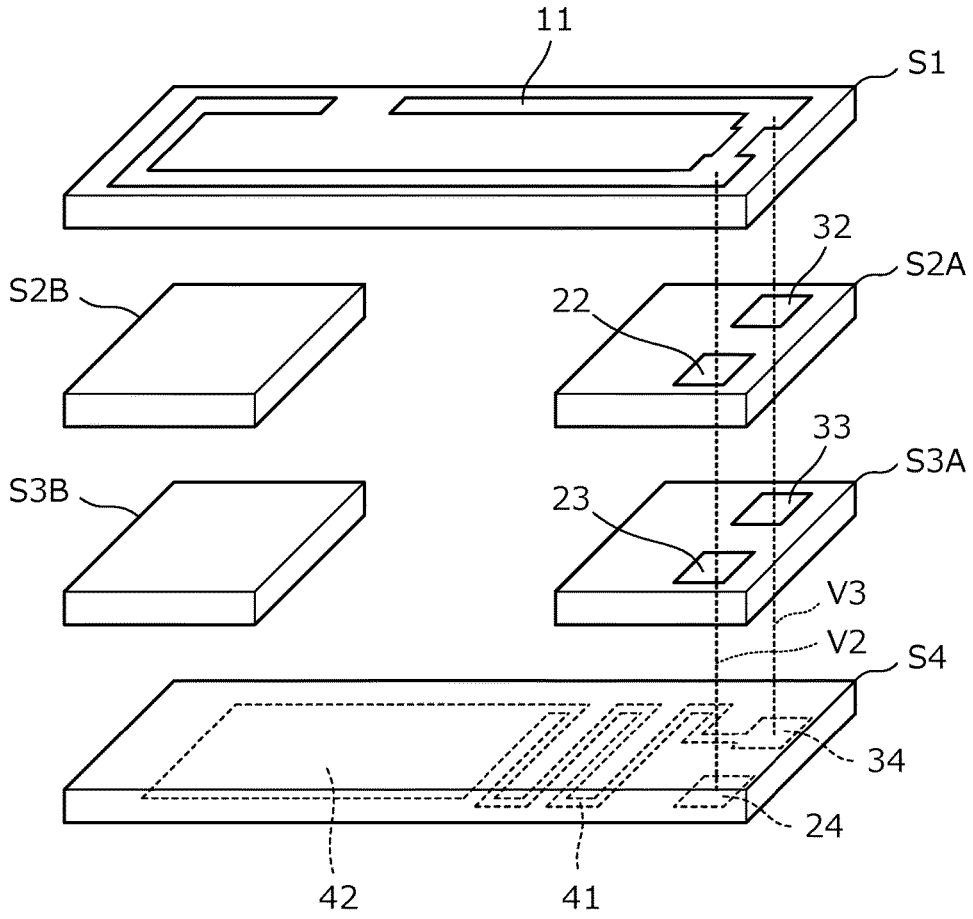
FIG. 9 is an exploded perspective view of an antenna element 103 according to a third preferred embodiment of the present invention.
Figure 10A:
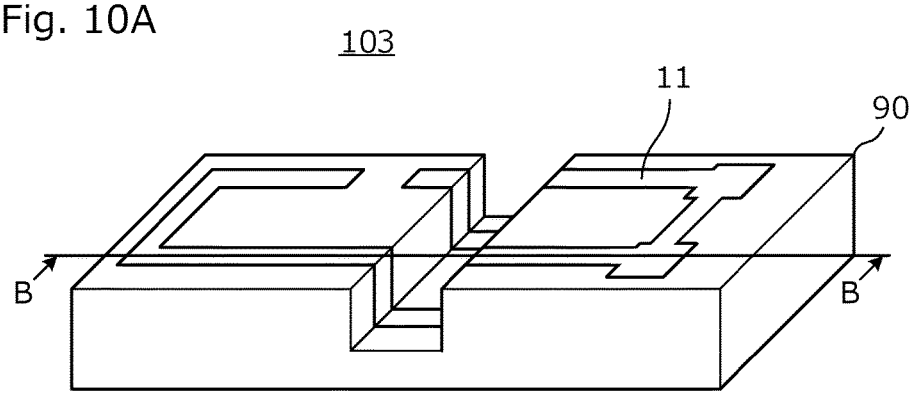
FIG. 10A is a perspective view of the antenna element 103.
Figure 10B:
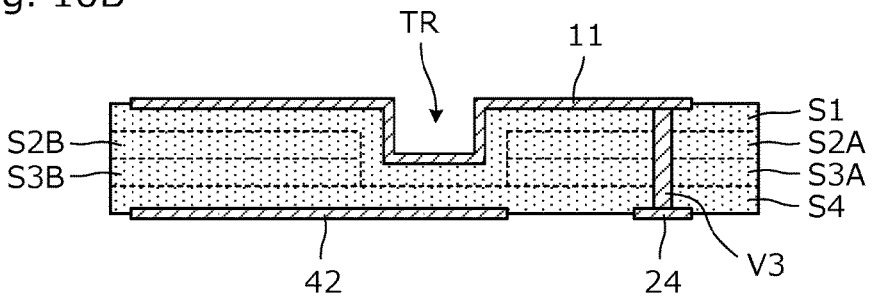
FIG. 10B is a cross-sectional view taken along a line B-B in FIG. 10A.
Figure 11:
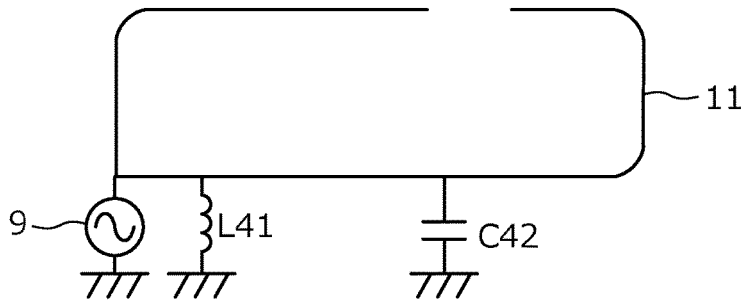
FIG. 11 is a circuit diagram in which the antenna element 103 is connected to a power supply circuit.

FIG. 9 is an exploded perspective view of an antenna element 103 according to the third preferred embodiment. FIG. 10A is a perspective view of the antenna element 103 and FIG. 10B is a cross-sectional view taken along a line B-B in FIG. 10A. FIG. 11 is a circuit diagram in which the antenna element 103 according to the present preferred embodiment is connected to a power supply circuit.

The antenna element 103 includes insulator layers S1, S2A, S2B, S3A, S3B, and S4. The structure of the insulator layer S4 is different from that of the first preferred embodiment shown in FIG. 3. A ground conductive pattern 42 and an inductor conductive pattern 41 are provided on a lower surface of the insulator layer S4 shown in FIG. 9. A first end of the inductor conductive pattern 41 is connected to a conductive pattern 34 and a second end of the inductor conductive pattern 41 is connected to the ground conductive pattern 42. The conductive pattern 24 is exposed to define and function as a terminal electrode and the ground conductive pattern 42 is also exposed to define and function as a terminal electrode. The other structures are identical to those of the first preferred embodiment.

In FIG. 11, an inductor L41 is an inductor with the inductor conductive pattern 41, and a capacitor C42 has the capacitance between a portion of the conductive pattern 11 defining and functioning as a radiation element, the portion located at the bottom surface of a trench TR, and the ground conductive pattern 42.

According to the present preferred embodiment, a reactance element is able to be connected between a predetermined position on the conductive pattern 11 defining and functioning as a radiation element and the ground. This achieves an antenna element in which the fundamental resonance frequency and high-order resonance frequency of the radiation element are set as the predetermined frequency. Further, it is possible to provide an antenna element including an antenna matching circuit.

Electrodes for capacitors may be provided on the insulator layers S2B and S3B and these capacitors may be connected between the predetermined position on the conductive pattern 11 and the ground conductive pattern 42. Conductive patterns for inductors may be provided on the insulator layers S2A and S3A and these inductors may be connected between the predetermined position on the conductive pattern 11 and the conductive pattern 34.

Fourth Preferred Embodiment

A fourth preferred embodiment of the present invention describes an example of an antenna element including a connector.

Figure 12:
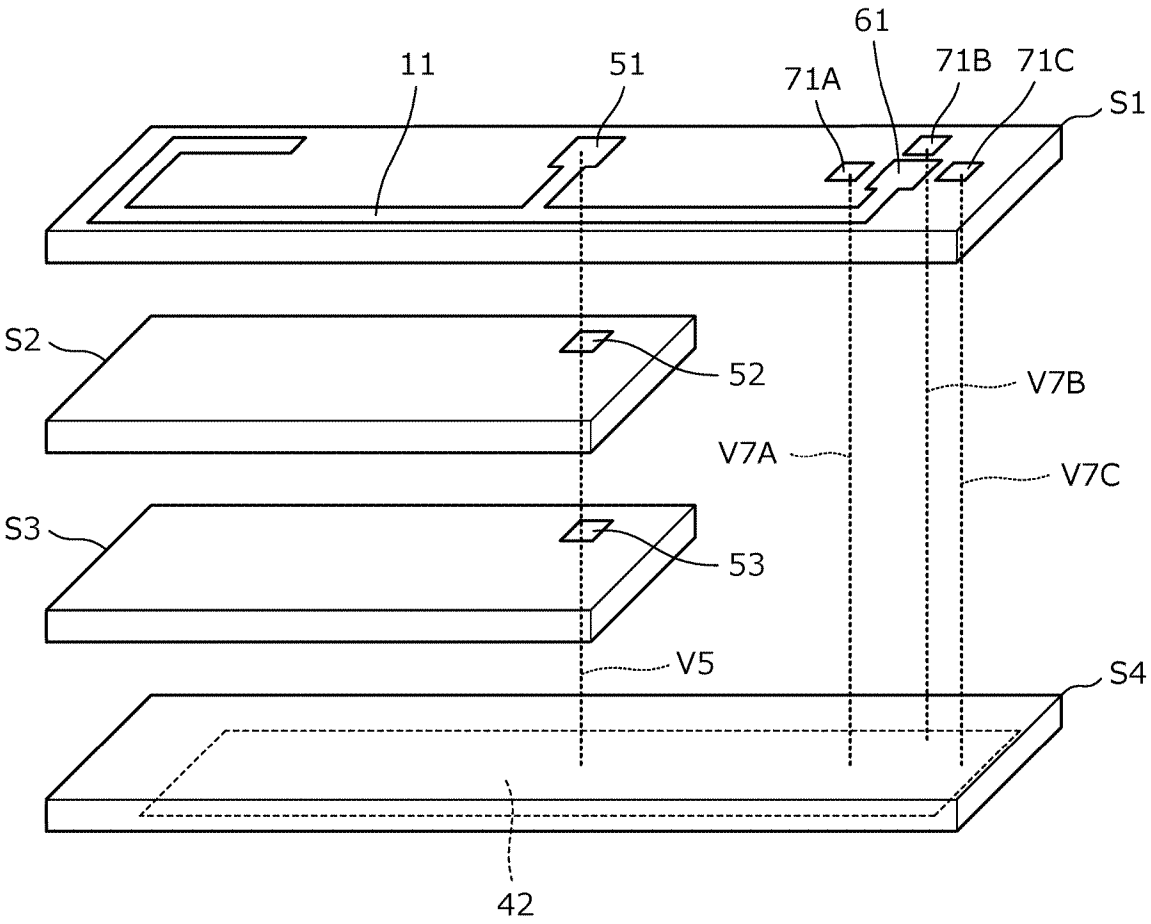
FIG. 12 is an exploded perspective view of an antenna element 104 according to a fourth preferred embodiment of the present invention.
Figure 13:
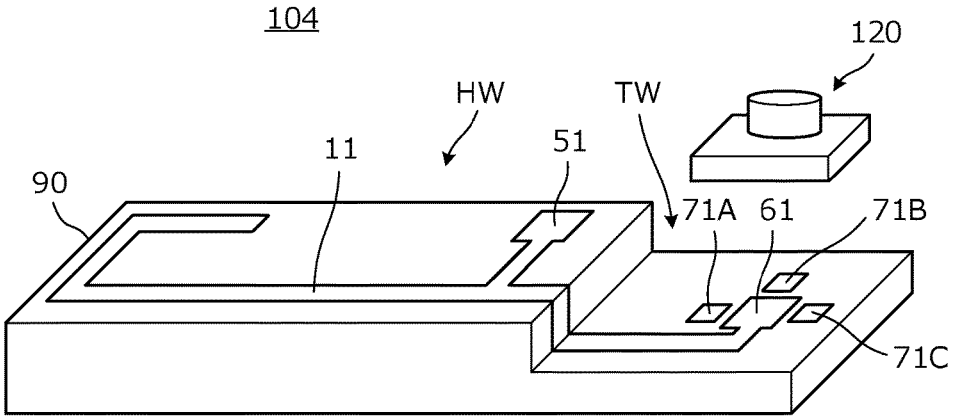
FIG. 13 is a perspective view of the antenna element 104 before mounting a coaxial connector 120 thereon.

FIG. 12 is an exploded perspective view of an antenna element 104 according to the fourth preferred embodiment. The connector is not shown in FIG. 12. FIG. 13 is a perspective view of the antenna element 104 before mounting a coaxial connector 120 thereon.

A laminate 90 is formed preferably by laminating insulator layers S1, S2, S3, and S4. The insulator layers S2 and S3 are smaller than the insulator layers S1 and S4. The laminate 90 includes an area where the insulator layers S1, S2, S3, and S4 are laminated and an area where the insulator layers S1 and S4 are laminated.

As the laminate is hot-pressed, a surface of the first insulator layer S1 defines a first principal surface PS1 of the laminate 90 and the first insulator layer S1 contacts the insulator layers S2, S3, and S4. In other words, the laminate 90 includes a thick wall portion HW and a thin wall portion TW depending on the number of laminated insulator layers, and thus a step is provided.

Conductive patterns 11, 51, 61, 71A, 71B, and 71C are provided on the surface of the first insulator layer S1. A conductive pattern 52 is provided on an upper surface of the insulator layer S2 and a conductive pattern 53 is provided on an upper surface of the insulator layer S3. A ground conductive pattern 42 is provided on a lower surface of the insulator layer S4. The ground conductive pattern 42 is exposed on a lower surface of the laminate 90.

The conductive patterns 61, 71A, 71B, and 71C are used as electrodes to connect the coaxial connector. The conductive pattern 51 is connected via a via conductor V5 to a predetermined position on the ground conductive pattern 42. The conductive patterns 71A, 71B, and 71C are connected through via conductors V7A, V7B, and V7C to predetermined positions on the ground conductive pattern 42, respectively.

As shown in FIG. 13, the conductive patterns 61, 71A, 71B, and 71C are provided on the thin wall portion TW of the laminate 90. The surface mounting coaxial connector 120 is soldered to the conductive patterns 61, 71A, 71B, and 71C. The coaxial connector 120 is mounted on the thin wall portion TW of the laminate 90 and the thin wall portion TW has high flexibility (deformability), and thus high operability is achieved when the coaxial connector (a plug) 120 is connected to the corresponding connector (the corresponding receptacle).

Figure 14:
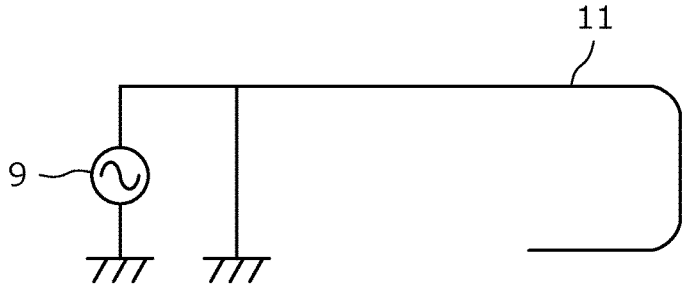
FIG. 14 is a circuit diagram in which the antenna element 104 is connected to a power supply circuit.

FIG. 14 is a circuit diagram in which the antenna element 104 according to the present preferred embodiment is connected to a power supply circuit. As the conductive pattern 11 defines and functions as a radiation element, an end of the conductive pattern 11 is connected to a power supply circuit 9, and a predetermined position on the conductive pattern 11 is grounded, the antenna element 104 defines and functions as an inverted-F antenna. The positional relationship between the conductive pattern 11 defining and functioning as a radiation element and the ground conductive pattern 42 remains constant, and thus the antenna element 104 is hardly influenced by a ground conductor and a metal portion of the device in which the antenna element 104 is mounted and achieves stable characteristics. It is not necessary to form a conductive pattern extending in a lamination direction of an insulator layer using an inter-layer connection conductor such as a via conductor and this prevents an increase in conductor loss.

Fifth Preferred Embodiment

A fifth preferred embodiment of the present invention describes an example of an antenna element including a component other than a connector mounted thereon.

Figure 15:
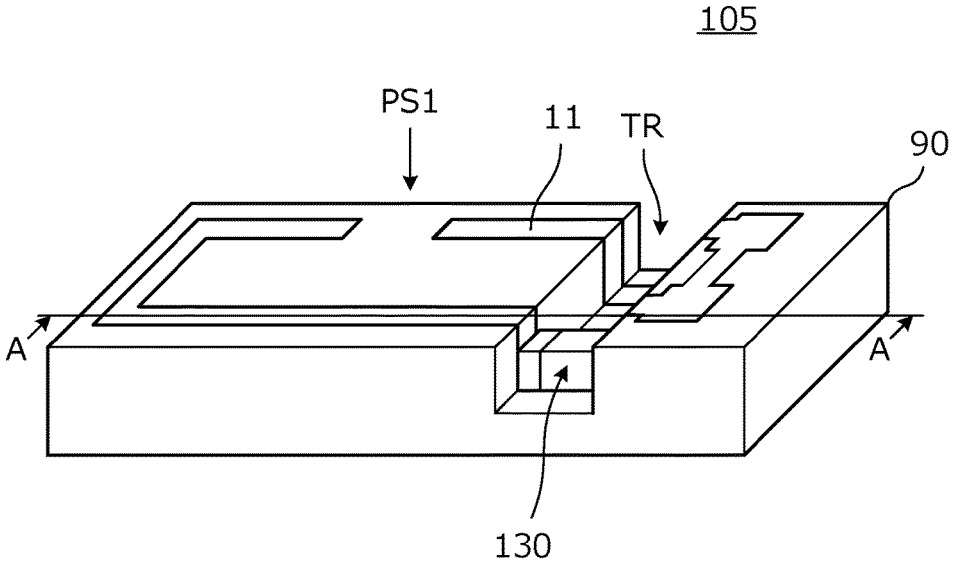
FIG. 15 is a perspective view of an antenna element 105 according to a fifth preferred embodiment of the present invention.
Figure 16:
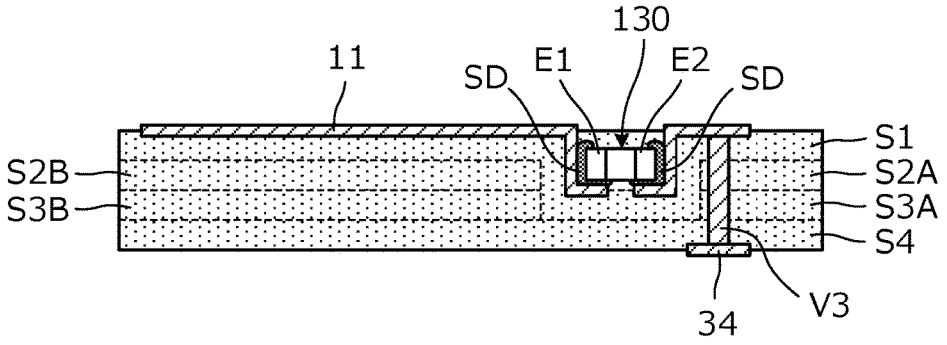
FIG. 16 is a cross-sectional view taken along a line A-A in FIG. 15.

FIG. 15 is a perspective view of an antenna element 105 according to the fifth preferred embodiment. FIG. 16 is a cross-sectional view taken along a line A-A in FIG. 15.

The antenna element 105 includes a laminate 90 formed preferably by laminating insulator layers, an antenna defined by a conductive pattern 11 on the laminate 90, and a chip component 130.

A trench TR is provided on a first principal surface PS1 of the laminate 90 (an upper surface of the laminate 90 from the view of FIG. 15). The conductive pattern 11 traverses the boundary between a portion not including the trench TR (thick wall portion) and the trench TR (thin wall portion).

The chip component 130 is connected to the conductive pattern 11 within the trench TR. The chip component 130 includes two external electrodes E1 and E2. These external electrodes E1 and E2 extend from the bottom surface to side surfaces (end surfaces) of the chip component 130. In the example of FIGS. 15 and 16, the external electrodes are preferably provided on five surfaces of each of both end portions of the rectangular parallelepiped chip component 130. The chip component 130 is soldered via a solder SD to the conductive pattern 11 within the trench TR.

The chip component 130 is electrically-serially inserted into a predetermined portion of the conductive pattern 11 defining and functioning as a radiation element. The other structures are identical to those of the antenna element 101 according to the first preferred embodiment.

According to the present preferred embodiment, if the chip component 130 defines and functions as a chip inductor, the effective length of the radiation element is able to be increased. If the chip component 130 defines and functions as a chip capacitor, the effective length of the radiation element is able to be reduced. Insertion of the chip component 130 enables the fundamental resonance frequency and high-order resonance frequency characteristics of the radiation element to be determined with a high degree of freedom.

According to the present preferred embodiment, the chip component 130 is bonded to the conductive pattern at the external electrodes on the bottom and side surfaces of the chip component 130 and this effectively increases the bond strength of the chip component 130. Even if the laminate 90 deforms, it is possible to prevent the chip component 130 from being separated from the laminate 90. It is also possible to prevent the increase in the thickness of the antenna element due to mounting of the chip component 130.

In the example shown in FIGS. 15 and 16, while the chip component 130 is disposed so that its longitudinal direction aligns with the width direction of the trench TR, the chip component may be disposed so that its longitudinal direction aligns with the extending direction of the trench TR and the geometry of the conductive pattern within the trench TR may be determined accordingly.

Other Preferred Embodiments

While the preferred embodiments describe examples in which the number of laminated insulator layers changes rapidly at a boundary between a thick wall portion and a thin wall portion, the present invention is not limited to such examples. The number of laminated insulator layers may change stepwise and the boundary between the thick wall portion and the thin wall portion may incline smoothly.

While the conductive pattern 11 defining and functioning as a radiation element preferably is exposed on a first principal surface of a laminate in the preferred embodiments described above, the conductive pattern 11 may be located in the interior of the laminate 90. Alternatively, after the laminate 90 is molded, a cover film or a resist film protecting the conductive pattern 11 may be located on the first principal surface PS1 of the laminate 90.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna element comprising:

an antenna defined by a conductive pattern in contact with a laminate that includes a plurality of insulator layers; wherein a surface of a first insulator layer of the plurality of insulator layers defines a first principal surface of the laminate;

the laminate includes a thick wall portion and a thin wall portion depending on a number of insulator layers being laminated; and the antenna is provided on the surface of the first insulator layer and a portion of the antenna traverses a boundary between the thick wall portion and the thin wall portion.

2. The antenna element according to claim 1, wherein the conductive pattern provided on at least one of the plurality of insulator layers is a ground conductive pattern.

3. The antenna element according to claims 1, wherein the conductive pattern provided on at least one of the plurality of insulator layers defines an inductor or a capacitor.

4. The antenna element according to claim 1, wherein each of the insulator layers is made of a deformable material; and a connector is disposed on the thin wall portion of the laminate.

5. The antenna element according to claim 4, wherein the connector is mounted on the first principal surface of the laminate and electrically connected to the conductive pattern provided on the first principal surface.

6. The antenna element according to claim 1, wherein a component is disposed on the thin wall portion of the laminate.

7. The antenna element according to claim 6, wherein the thin wall portion of the laminate defines a trench on the first principal surface of the laminate;

the component includes an external electrode on a bottom surface and a side surface; and the component is disposed in the trench of the laminate and the external electrode of the component is bonded to the conductive pattern in the trench.

8. The antenna element according to claim 1, wherein additional conductive patterns are provided on additional ones of the plurality of insulator layers.

9. The antenna element according to claim 1, wherein the first principal surface of the laminate includes recesses and protrusions, and the conductive pattern is located in the recesses and the protrusions.

10. The antenna element according to claim 1, wherein the first principal surface of the laminate includes steps, and the conductive pattern is located in the steps.

11. The antenna element according to claim 1, wherein the antenna element defines an inverted-F antenna.

12. The antenna element according to claim 1, wherein the antenna element defines a dual-band antenna.

13. The antenna element according to claim 1, wherein the first insulator layer includes cut-away portions.

14. The antenna element according to claim 13, wherein the cut-away portions are located in an upper surface and a lower surface of the first insulator layer.

15. The antenna element according to claim 1, wherein a second insulator layer of the plurality of insulator layers includes an inductor conductive pattern and a ground conductive pattern on a surface thereof.

16. The antenna element according to claim 1, wherein the plurality of insulator layers include different size insulator layers.

17. A method of manufacturing an antenna element including an antenna defined by a conductive pattern in contact with a laminate formed by laminating a plurality of insulator layers, the method comprising:

a first step of preparing a plurality of insulating bases corresponding to the plurality of insulator layers;

a second step of forming the conductive pattern on a predetermined insulating base of the plurality of insulating bases;

a third step of laminating the plurality of insulating bases such that a first insulator layer with a surface that defines a first principal surface of the laminate is formed, an area that becomes a thick wall portion or a thin wall portion depending on a number of insulator layers being laminated is formed, and a portion of the conductive pattern traverses a boundary between the thick wall portion and the thin wall portion; and a fourth step of pressurizing the laminate.

18. The method of manufacturing an antenna element according to claim 17, wherein each of the insulating bases is made of a thermoplastic resin and the fourth step is a step of integrally molding the laminate by hot pressing.

19. The method of manufacturing an antenna element according to claim 17, further comprising a step of forming a cut-away portion in the first insulating base; wherein the insulating bases are laminated in the third step such that the cut-away portion is placed on the boundary between the thick wall portion and the thin wall portion.

* * * * *